US006048180A

United States Patent [19]

Konishi et al.

[11] Patent Number: 6,048,180

[45] Date of Patent: Apr. 11, 2000

[54] HIGH-PRESSURE FUEL SUPPLY PUMP

[75] Inventors: Keiichi Konishi; Keisaku Zenmei; Tatsuya Ikegami; Hidekazu Baba, all of Tokyo, Japan

[73] Assignee: Mitsubishi Denki Kabushiki Kaisha, Tokyo, Japan

[21] Appl. No.: 09/130,464

[22] Filed: Aug. 7, 1998

[30] Foreign Application Priority Data

Jan. 30, 1998 [JP] Japan ..... 10-018899

[51] Int. Cl.[7] ..... F05B 17/00; F02M 37/04

[52] U.S. Cl. ..... 417/364; 123/495

[58] Field of Search ..... 417/387, 499, 417/364, 321, 462; 222/3; 123/446, 514, 506, 507, 508, 495

[56] References Cited

U.S. PATENT DOCUMENTS 5,567,134 10/1996 Inoue .

FOREIGN PATENT DOCUMENTS 8-14140 1/1996 Japan .
8-210219 3/1996 Japan .
8-68370 3/1996 Japan .
87212063 12/1997 Japan .

*Primary Examiner*—John A. Jeffery
*Assistant Examiner*—Daniel Robinson
*Attorney, Agent, or Firm*—Sughrue, Mion, Zinn, Macpeak & Seas, PLLC

[57] ABSTRACT

A high-pressure fuel supply pump with high performance is capable of securely preventing a cylinder section from seizing up and also permits improved sealing performance to minimize the chance of fuel leakage. The high-pressure fuel supply pump has: a casing (48) having a cylindrical cavity (48*a*); a sleeve (40) which has a cylinder section (40*a*) and a fixing section (40*c*), one end thereof closer to the fixing section (40*c*) being abutted against the bottom of the cavity (48*a*); and a piston (53) which is disposed in the cylinder section (40*a*). The high-pressure fuel supply pump takes in fuel through an intake passage (36) by the reciprocation of the piston (53) into a fuel pressurizing chamber (52) to pressurize it, then discharges the pressurized fuel through a discharge passage (37) to forcibly feed it into a fuel injector of a cylinder injection engine. A cylindrical slit (40*d*) is provided between the cylinder section (40*a*) and the fixing section (40*c*) of the sleeve (40), and the fixing section (40*c*) is secured by being fastened toward the bottom of a cavity (48*a*) by a cylindrical fastening member (64) screwed to the cavity (48*a*).

3 Claims, 5 Drawing Sheets

HIGH-PRESSURE FUEL SUPPLY PUMP

BACKGROUND OF THE INVENTION

1. Field of the Invention

The present invention relates to a high-pressure fuel supply pump for supplying fuel to the fuel injector of a cylinder injection engine.

2. Description of the Related Art

FIG. 5 is a sectional view showing a conventional high-pressure fuel supply pump. A high-pressure fuel supply pump 1 shown in FIG. 5 is mounted on a housing or the like of an engine, which is not shown; it is driven via a cam 39 which rotates at half the rotation speed of the engine. Formed in a casing 48 of the high-pressure fuel supply pump 1 are an intake passage 36, a discharge passage 37, and a return passage 26. Further, a cylindrical cavity 48*a* is formed at the bottom of FIG. 5.

A sleeve 70 having a cylinder section 70*a* is provided in the cavity 48*a*, the sleeve 70 being disposed with one end thereof oriented toward a bottom section 48*b* of the cavity 48*a*. The sleeve 70 is composed of the cylinder section 70*a*, a thick-wall section 70*b* formed by increasing the wall thickness of one end of the bottom section 48*b* of the cylinder section 70*a*, and a fixing section 70*c* shaped into a flange on the end of the thick-wall section 70*b*, the end being the one closer to the bottom section 48*b*.

Provided between the bottom section 48*b* and the sleeve 70 are a first plate 45, a second plate 47, and a lead valve 46 clamped therebetween. The first plate 45 and the second plate 47 have an intake port communicated with the intake passage 36, a discharge port communicated with the discharge passage 37, and a return port. The lead valve 46 is provided with an intake valve and a discharge valve which are located at the positions matched to the intake port and the discharge port, respectively, and which allow fuel to pass only in one direction, and a return port.

In the cylinder section 70*a* of the sleeve 70, a substantially cylindrical piston 53 is provided so that it may reciprocate. The piston 53 and the cylinder 70*a* together constitute a fuel pressurizing chamber 52. A compression coil spring 55 is held in a compressed state in the fuel pressurizing chamber 52, the compression coil spring 55 being positioned by a spring holder 54.

Provided around the sleeve 70 is a housing 44 which surrounds the sleeve 70. The housing 44 is shaped like a substantially bottomless bowl; it has a cylindrical edge section 44*a* on the outer periphery thereof. A holder 42 is secured to the end of the piston 53 on the opposite side from the fuel pressurizing chamber 52. A metallic bellows 43 is provided between the housing 44 and the holder 42; the bellows 43 holds therein the fuel which has leaked through between the piston 53 and the sleeve 70.

A bottomed cylindrical tappet 56 serving as a driver is held against the end of the piston 53 on the opposite side from the fuel pressurizing chamber 52; the tappet 56 has a cam roller 59, which is rotatably supported by a pin 57, therein. The cam roller 59 is abutted against the cam surface of a cam 39. A spring holder 60 is secured to the tappet 56, and a compression coil spring 61 is provided in a compressed state between the spring holder 60 and the housing 44.

Provided around the compression coil spring 61 is a bracket 58 for securing the high-pressure fuel supply pump 1 to the housing or the like of an engine, which is not shown. The bracket 58 has a substantially cylindrical shape and it has a flanged section 58*a* in the middle thereof, the flanged section 58*a* having a plurality of through holes 49 at predetermined points around the circumference thereof. The casing 48 has tapped holes 50 at the positions matched to the through holes 49. Bolts 51 are inserted in the through holes 49 to be tightened into the tapped holes 50. This tightly secures the bracket 58 to the casing 48. The high-pressure fuel supply pump 1 is fixed to the housing or the like of the engine, not shown, by the outer peripheral section of the bracket 58 thereof being supported.

One end section 58*c* of the bracket 58 pushes an edge section 44*a* of the housing 44 to push the fixing section 70*c* of the sleeve 70 against the casing 48 via the edge section 44*a*. This fastens the sleeve 70 to the casing 48. The fixing section 70*c* must be securely fastened to ensure good sealing relative to the plate 47 and to prevent fuel leakage through the lead valve 46. A predetermined gap is formed between the rear surface of the flanged section 58*a* and the casing 48 so as to permit the fixing section 70*c* to be firmly pushed.

A tappet sliding surface 58*b* is formed on the inner side of the opening end of the bracket 58 on the opposite side from the flanged section 58*a*. The tappet sliding surface 58*b* supports the tappet 56 so that it may reciprocate.

Formed in the casing 48 are a fuel inlet 18*a* communicated with the intake passage 36 and afuel discharge port 18*b* communicated with the discharge passage 37. The fuel inlet 18*a* is provided with a filter 19. A piston damper 21 is provided in the middle of the intake passage 36. A buffer vessel 23 and a resonator 24 are provided in the middle of the discharge passage 37; the buffer vessel 23 and the resonator 24 are communicated with a communicating passage 25. A return passage 26 returns the fuel accumulated in the bellows 43 to a fuel tank, which is not shown. Connected to the casing 48 is a return pipe 27 that is connected to the return passage 26. Further, a return pipe 28 is connected to a piston damper 21.

In the high-pressure fuel supply pump thus constructed, the piston 53 is pressed against the tappet 56 by the compression coil spring 55, the tappet 56 being pressed by the compression coil spring 61 so that it is held always in contact with the cam 39. The rotation of the cam 39 causes the piston 53 to reciprocate in the cylinder section 70*a*.

When the piston 53 comes down, the fuel flows from the intake passage 36 and passes through the lead valve 46 into the fuel pressurizing chamber 52. When the piston 53 goes up, the intake valve of the lead valve 46 closes, while the discharge valve opens to let the fuel in the fuel pressurizing chamber 52 to be discharged through the discharge passage 37. The fuel leaked from between the piston 53 and the sleeve 70 is accumulated in the bellows 43 and returned to the fuel tank, not shown, through the return passage 26.

In the high-pressure fuel supply pump having the constitution described above, the sleeve 70 is secured to the casing 48 by being fastened by the bracket 58. When fixing the sleeve 70, however, the fixing section 70*c* is subjected to the compressing force acting in the axial direction of the cylinder section 70*a*, thus deforming the inner surface of the cylinder section 70*a*.

FIG. 6 is a sectional view showing the shape of the conventional sleeve 70 when it has been deformed. The arrows in the drawing indicate the directions of the forces applied when the sleeve 70 is secured to the casing 48; the solid lines show the configuration before the sleeve 70 is fastened to the casing 48, the dashed lines show the deformation after the fastening, and the chain line indicates the highest position of the stroke of the piston 53.

The sleeve 70 is secured to the casing 48 by the fixing section 70*c* which is firmly fastened in the vertical direction in FIG. 6. At this time, the deformation that takes place in the fixing section 70*c* is transmitted to the sleeve 70, causing the inner surface of the cylinder section 70*a* as indicated by the dashed lines. There has been a problem in that the deformation adversely affects the reciprocating motion of the piston 53 and causes the projecting section of the inner surface of the cylinder 70*a* to wear abnormally with consequent seizure.

Further, the predetermined gap is formed between the rear surface of the flanged section 58*a* and the casing 48, whereas the fastening bolts 51 are disposed at the predetermined positions in the circumferential direction; therefore, firmly fastening the bracket 58 onto the casing 48 undesirably causes the flanged section 58*a* to develop wavy deformation in the circumferential direction. This leads to uneven circumferential force pressing the fixing section 70*c* of the sleeve 70, and the sleeve 70 deforms also in the circumferential direction. As a result, the reciprocating motion of the piston 53 is further affected and the sealing performance is deteriorated with consequent deterioration in the performance of the pump.

In addition, the deformation of the bracket 58 also adversely affects the reciprocating motion of the tappet 56, deteriorating the slidability of the tappet 56.

SUMMARY OF THE INVENTION

Accordingly, the present invention has been made with a view toward solving the problem described above, and it is an object thereof to provide a high-pressure fuel supply pump with high performance that is capable of securely preventing the seizure of a cylinder section and of improving the sealing performance to minimize fuel leakage.

To this end, according to the present invention, there is provided a high-pressure fuel supply pump comprising: a casing in which an intake passage for taking fuel in, a discharge passage for discharging fuel, and a cylindrical cavity are formed; a sleeve which has a cylinder section and a flanged fixing section provided on one end of the cylinder section, one end thereof closer to the fixing section being abutted against the bottom of the cavity; and a piston which is disposed in the cylinder section so that it may reciprocate and which constitutes a fuel pressurizing chamber in cooperation with the cylinder section; the high-pressure fuel supply pump taking in fuel through the intake passage by the reciprocation of the piston into the fuel pressurizing chamber to pressurize it, then discharging the pressurized fuel through the discharge passage to forcibly feed it into a fuel injector of a cylinder injection engine; wherein a cylindrical slit is provided between the cylinder section and the fixing section of the sleeve, and the fixing section is secured by being fastened toward the bottom of the cavity by a cylindrical fastening member screwed to the cavity.

In a preferred form of the present invention, the high-pressure fuel supply pump further includes a bracket to be secured to an engine; wherein the inside diameter portion of the bracket is positioned by being spigot-fitted to the fastening member.

In another preferred form of the present invention, the high-pressure fuel supply pump further includes a driver which is provided between the piston and the engine cam and which transmits the power of the cam to the piston; wherein the bracket guides the driver so that it may reciprocate.

DESCRIPTION OF THE PREFERRED EBODIMENTS

FIRST EMBODIMENT

Figure 1:
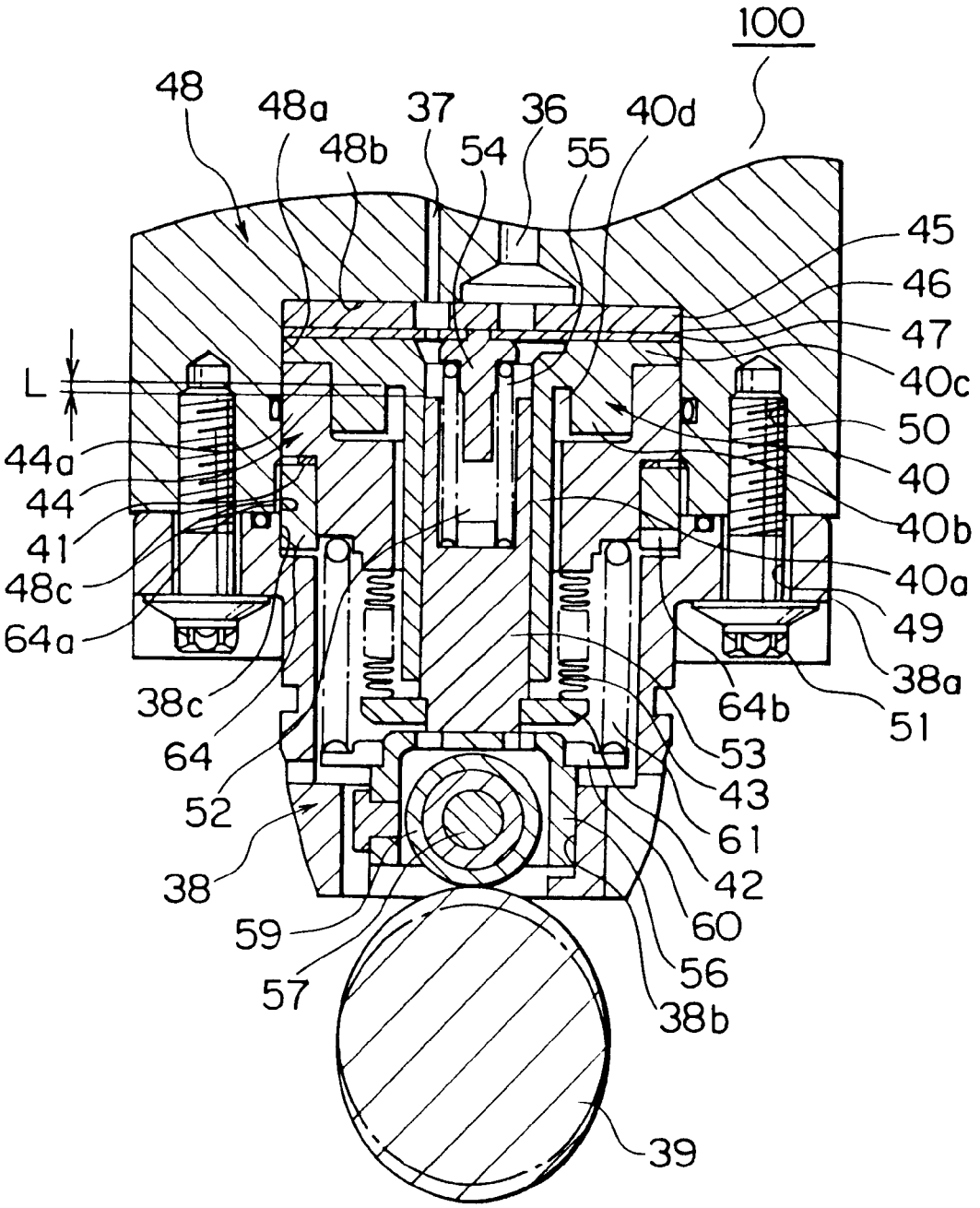
FIG. 1 is a sectional view showing a high-pressure fuel supply pump in accordance with the present invention.

FIG. 1 is a sectional view showing a high-pressure fuel supply pump in accordance with the present invention. A high-pressure fuel supply pump 100 shown in FIG. 1 is mounted on a housing or the like of an engine, not shown; it is driven via a cam 39 which rotates at half the rotational speed of the engine. Formed in a casing 48 of the high-pressure fuel supply pump 100 are an intake passage 36 and a discharge passage 37. Further, a cylindrical cavity 48*a* is formed at the bottom of FIG. 1.

A sleeve 40 having a cylinder section 40*a* is provided in the cavity 48*a*, the sleeve 40 being disposed with one end thereof oriented toward a bottom section 48*b* of the cavity 48*a*. The sleeve 40 is composed of the cylinder section 40*a*, a thick-wall section 40*b* formed by increasing the wall thickness of one end of the bottom section 48*b* of the cylinder section 40*a*, and a fixing section 40*c* shaped into a flange on the end of the thick-wall section 40*b*, the end being the one closer to the bottom section 48*b*. Further, a cylindrical slit 40*d* having an opening on the side opposite from the bottom section 48*b* is formed at the boundary of the cylinder section 40*a* and the thick-wall section 40*b*.

Provided between the bottom section 48*b* and the sleeve 40 are a first plate 45, a second plate 47, and a lead valve 46 clamped therebetween. The first plate 45 and the second plate 47 have an intake port communicated with the intake passage 36, a discharge port communicated with the discharge passage 37, and a return port, which is not shown. The lead valve 46 is provided with an intake valve and a discharge valve which are located at the positions matched to the intake port and the discharge port, respectively, and which allow fuel to pass only in one direction, and a return port.

In the cylinder section 40*a* of the sleeve 40, a substantially cylindrical piston 53 is provided so that it may reciprocate. The piston 53 and the cylinder 40*a* together constitute a fuel pressurizing chamber 52. A compression coil spring 55 is held in the fuel pressurizing chamber 52 in a compressed state, the compression coil spring 55 being positioned by a spring holder 54.

Provided around the sleeve 40 is a housing 44 which surrounds the sleeve 40. The housing 44 is shaped like a substantially bottomless bowl; it has a cylindrical edge section 44*a* on the outer periphery thereof. Provided around the housing 44 is a cylindrical fastening member 64 disposed under the edge section 44*a* as illustrated in FIG. 1, an annular washer 41 being placed between the housing 44 and the fastening member 64. The outer peripheral surface of the fastening member 64 is provided with an external thread 64*a*, while the housing recessed section 48*a* of the casing 48 is provided with an internal thread 48*c*, so that the fastening member 64 is attached to the casing 48 by screwing the external thread 64*a* to the internal thread 48*c*. As the screwing proceeds, the fastening member 64 pushes the fixing section 40*c* of the sleeve 40 in the axial direction of the cylinder section 40*a*, i.e. toward the bottom section 48*b* of the cavity 48*a*, via the edge section 44*a* of the housing 44 so as to secure the sleeve 40 to the casing 48. At this time, the fixing section 40*c* is pushed by a uniform force in the circumferential direction applied by the fastening member 64 via the washer 41.

A holder 42 is secured to the end of the piston 53 on the opposite side from the fuel pressurizing chamber 52. A metallic bellows 43 is provided between the housing 44 and the holder 42; the bellows 43 holds therein the fuel which has leaked through between the piston 53 and the sleeve 40.

A bottomed cylindrical tappet 56 serving as a driver is held against the end of the piston 53 on the opposite side from the fuel pressurizing chamber 52; the tappet 56 has a cam roller 59, which is rotatably supported by a pin 57, therein. The cam roller 59 is abutted against the cam surface of a cam 39. A spring holder 60 is secured to the tappet 56, and a compression coil spring 61 is provided in a compressed state between the spring holder 60 and the housing 44.

Provided around the compression coil spring 61 is a bracket 38 for securing the high-pressure fuel supply pump 100 to the housing or the like of an engine, which is not shown. The bracket 38 has a substantially cylindrical shape and it has a flanged section 38*a* at the opening end on one side thereof, the opening end on the opposite side from the flanged section 38*a* is slightly narrowed inward. The bracket 38 is positioned by spigot-fitting the inside diameter section 38*c* facing the flanged section 38*a* to the fastening member 64. The rear surface of the flanged section 38*a* is brought in surface-contact with the casing 48. The flanged section 38*a* of the bracket 38 has a plurality of through holes 49 at predetermined points around the circumference thereof. The casing 48 has tapped holes 50 at the positions matched to the through holes 49. Bolts 51 are inserted in the through holes 49 to be tightened into the tapped holes 50. The high-pressure fuel supply pump 100 is fixed to the housing or the like of the engine, not shown, by the outer peripheral section of the bracket 38 thereof being supported.

A tappet sliding surface 38*b* is formed on the inner side of the opening end of the bracket 38 on the opposite side from the flanged section 38*a*. The tappet sliding surface 38*b* supports the tappet 56 so that it may reciprocate.

Figure 2:
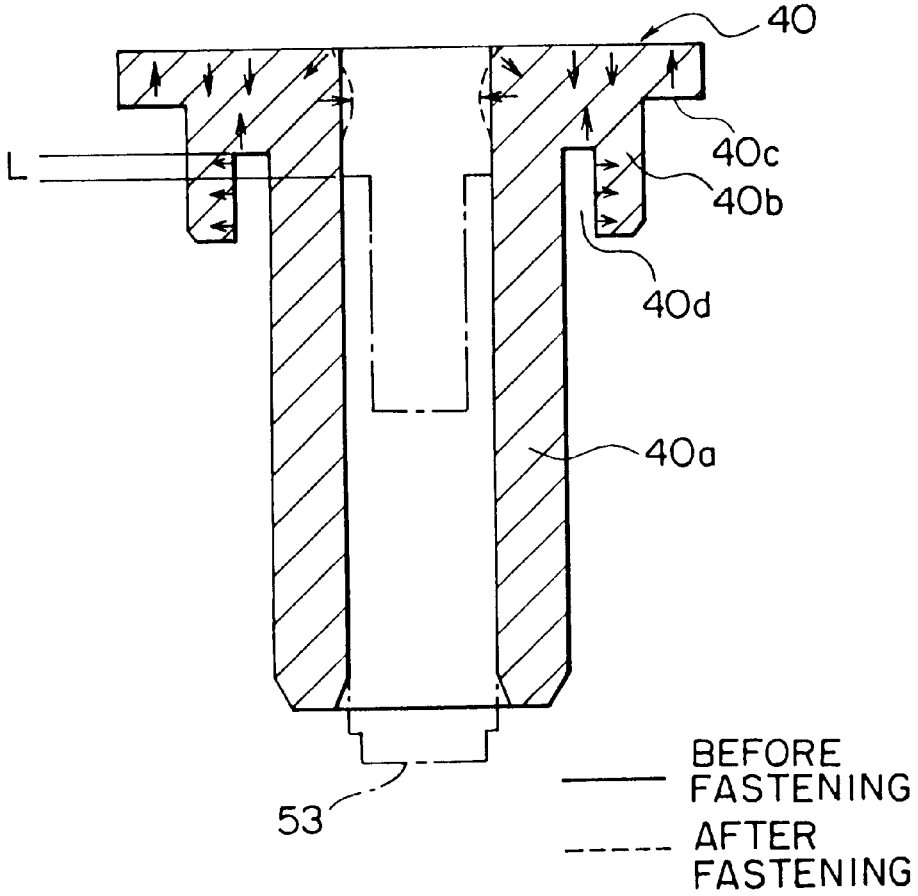
FIG. 2 is a sectional view illustrating how a sleeve in accordance with the present invention is deformed.

FIG. 2 is a sectional view showing the shape of the sleeve 40 when it has been deformed. The arrows in the drawing indicate the directions of the forces applied when the sleeve 40 is secured to the casing 48; the solid lines show the configuration before the sleeve 40 is fastened to the casing 48, the dashed lines show the deformation after the fastening, and the chain line indicates the highest position of the stroke of the piston 53.

The sleeve 40 is secured to the casing 48 by having the fixing section 40*c* pushed. Since the slit 40*d* is formed between the cylinder section 40*a* and the fixing section 40*c* of the sleeve 40, it is difficult for the deformation of the fixing section 40*c* to be transmitted to the cylinder section 40*a*, causing less deformation of the cylinder section 40*a*. Moreover, the slit 40*d* is formed such that it is deeper by length L than the highest position of the stroke of the piston 53; hence, the cylinder section 40*a* deforms only in the upper portion thereof in the vicinity of the fuel pressurizing chamber 52. Hence, the deformation of the cylinder section 40*a* does not adversely affect the reciprocating motion of the piston 53.

Figure 3:
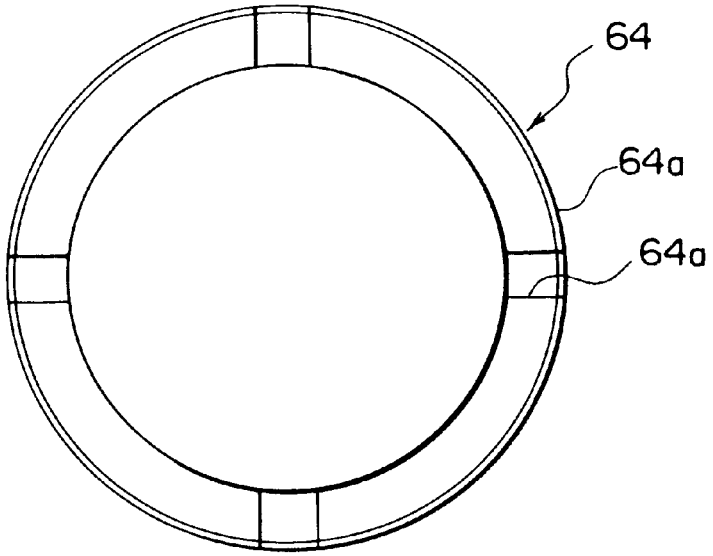
FIG. 3 shows a fastening member observed from the cam side.

FIG. 3 shows the fastening member 64 observed from the side of the cam 39. The cylindrical fastening member 64 is provided with the external thread 64*a* engraved on the outer peripheral surface thereof; formed on the end surface on one side thereof are four notches 64*b* which are provided equidistantly in the circumferential direction and with which a tool is engaged to fasten the fastening member 64 to the casing 48.

In the high-pressure fuel supply pump thus constructed, the piston 53 is pressed against the tappet 56 by the compression coil spring 55, the tappet 56 being pressed by the compression coil spring 61 so that it is held always in contact with the cam 39. The rotational force of the cam 39 is transmitted to the piston 53 via the tappet 56 to reciprocate in the cylinder section 40*a*.

When the piston 53 comes down, the fuel flows from the intake passage 36 and passes through the lead valve 46 into the fuel pressurizing chamber 52. When the piston 53 goes up, the intake valve of the lead valve 46 closes, while the discharge valve opens to let the fuel in the fuel pressurizing chamber 52 to be discharged through the discharge passage 37. The fuel leaked from between the piston 53 and the sleeve 40 is accumulated in the bellows 43 and returned to the fuel tank through a return passage, which is not shown.

In the high-pressure fuel supply pump having the constitution described above, the sleeve 40 is secured to the casing 48 by the fixing section 40*c* being pressed with an even force in the circumferential direction by the cylindrical fastening member 64; hence, the deformation becomes uniform in the circumferential direction. Since the slit 40*d* is formed between the cylinder section 40*a* and the fixing section 40*c* of the sleeve 40, it is difficult for the deformation of the fixing section 40*c* to be transmitted to the cylinder section 40*a*, resulting in less deformation of the cylinder section 40*a*. In addition, since the slit 40*d* is formed such that it is deeper by length L than the highest position of the stroke of the piston 53, the deformation occurring in the cylinder section 40*a* takes place in a portion that is not involved in the sliding motion of the piston 53. This makes it possible to securely prevent the seizure of the piston 53.

Moreover, the less deformation developed in the sleeve 40 allows the sleeve 40 to be secured to the casing 48 with a greater fastening force, thus permitting improved sealing between the casing 48, the plates 45 and 47, the lead valve 46, the sleeve 40, and the housing 44. The result is a high-pressure fuel supply pump with higher performance with minimized chance of fuel leakage.

The bracket 38 is positioned by the spigot-fitting to the cylindrical fastening member 64. This ensures accurate centering of the bracket 38 and also permits easier assembly.

Furthermore, the bracket 38 is not involved in the fastening of the sleeve 40, and the rear surface of the flanged section 38*a* is in surface contact with the casing 48; therefore, it does not deform in the wavy fashion in the circumferential direction when it is fastened by the bolts 51. Thus, the tappet 56 can be guided with high accuracy. This leads to smoother reciprocating motion of the piston 53, contributing to higher performance of the high-pressure fuel supply pump.

The number of the notches 64*b* provided in the fastening member 64 is not limited to four; it may alternatively be two, three, five, or six.

SECOND EMBODIMENT

Figure 4:
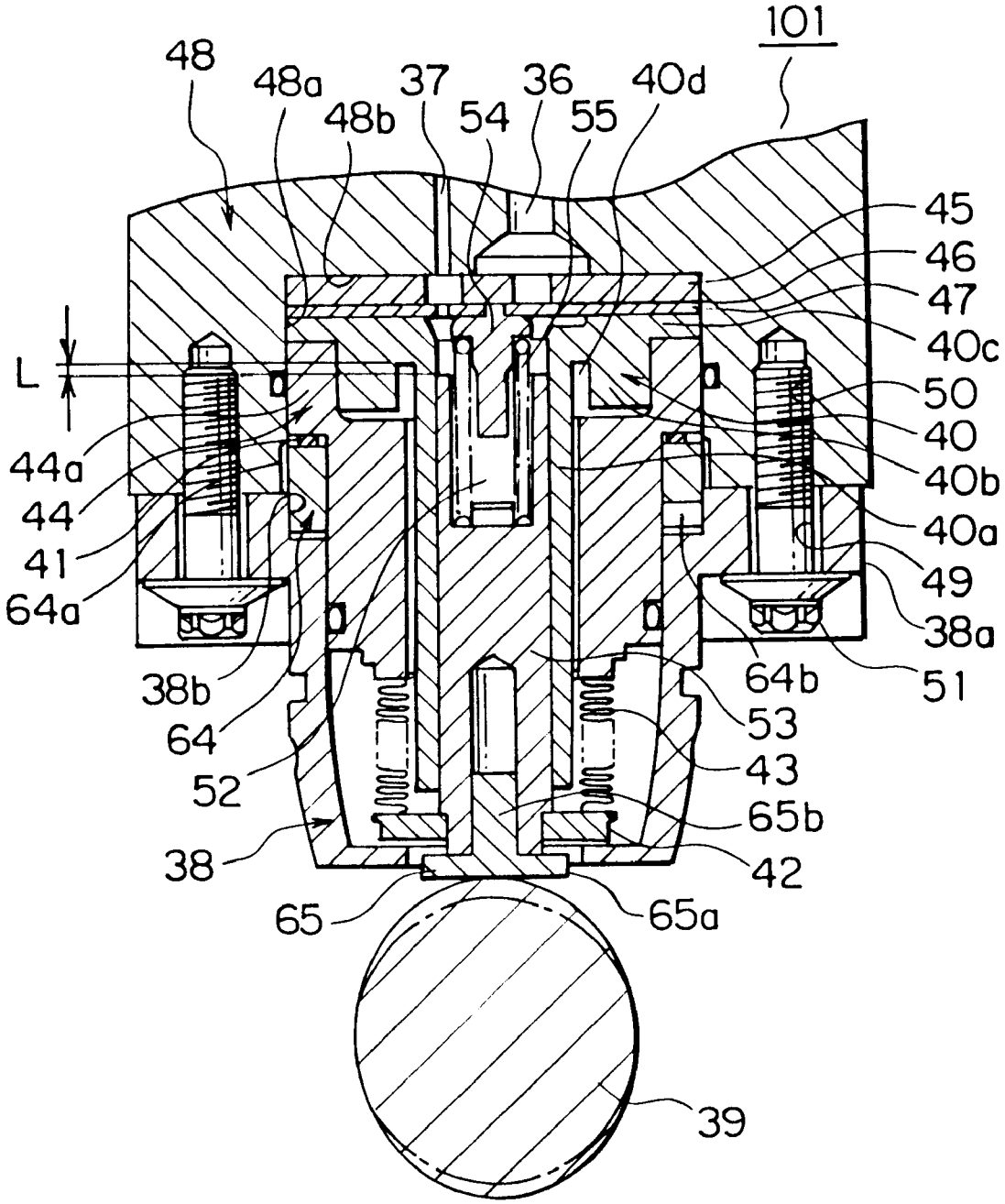
FIG. 4 is a sectional view showing another example of the high-pressure fuel supply pump in accordance with the present invention.
Figure 5:
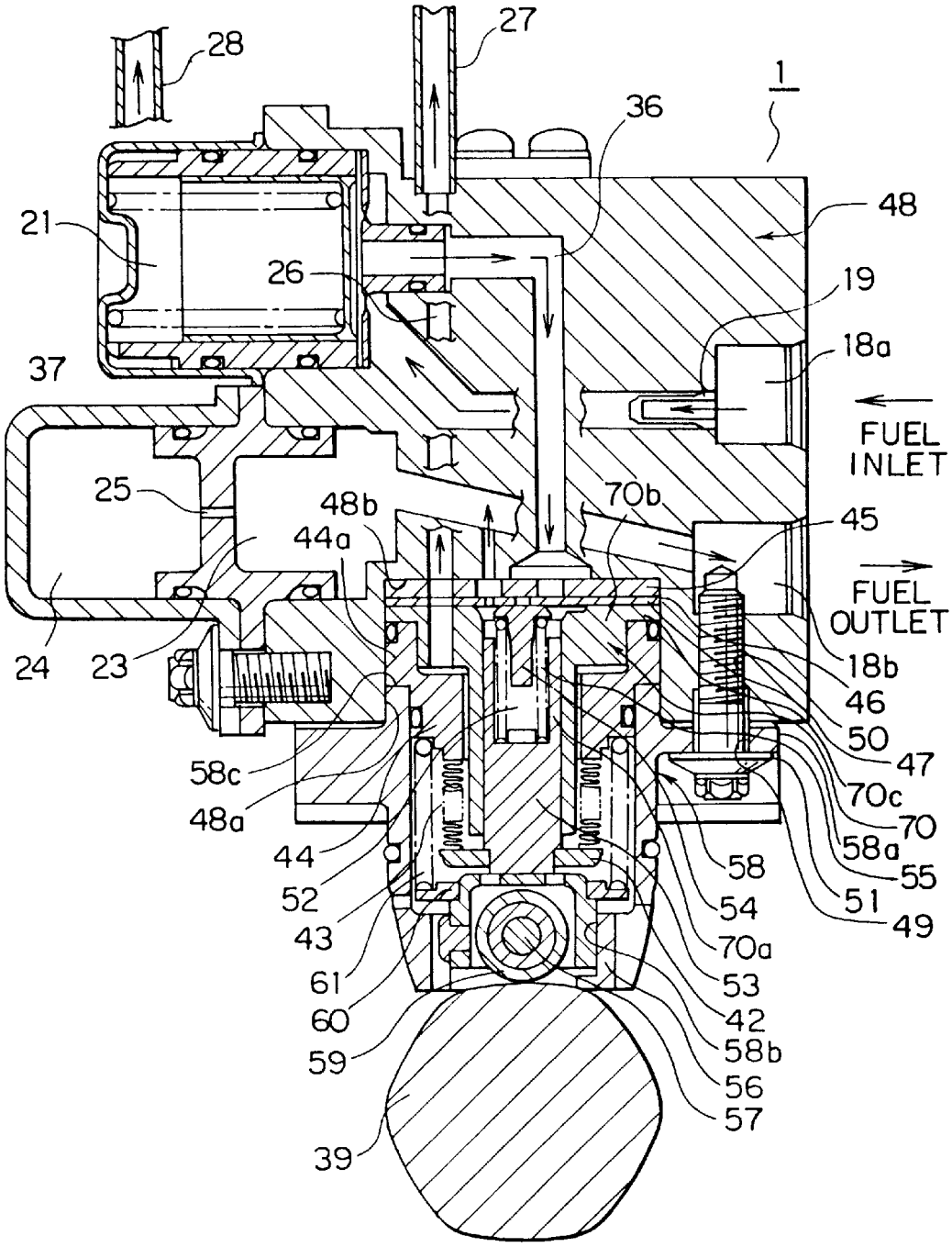
FIG. 5 PRIOR ART
FIG. 5 is a sectional view showing a conventional high-pressure fuel supply pump.
Figure 6:
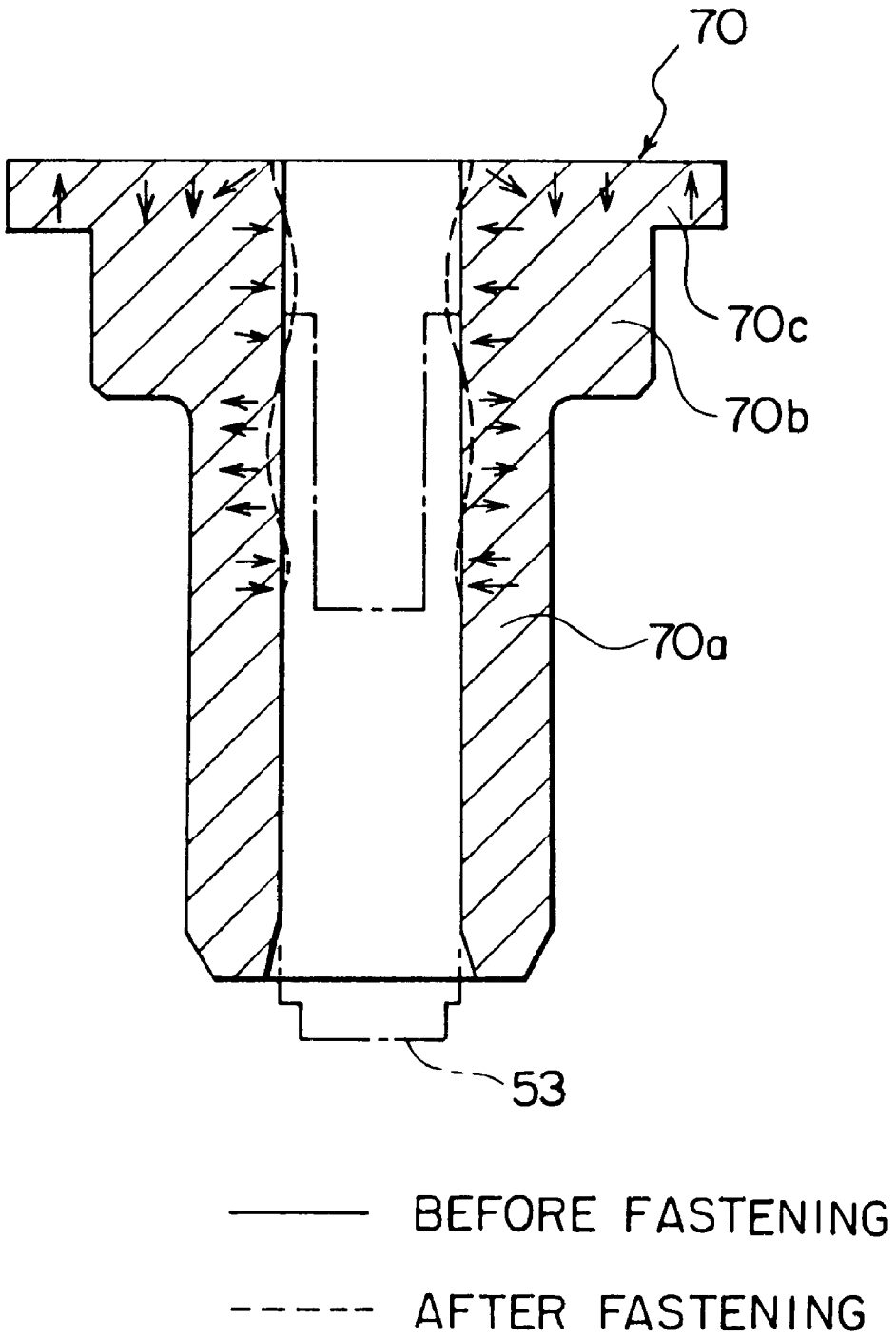
FIG. 6 PRIOR ART
FIG. 6 is a sectional view showing how a conventional sleeve is deformed.

FIG. 4 is a sectional view showing another example of the high-pressure fuel supply pump in accordance with the present invention. A high-pressure fuel supply pump 101 of this embodiment is a type without a cam roller. A tappet 65 serving as a driver is fixed to the end of a piston 53 on the side opposite from a fuel pressurizing chamber 52. The tappet 65 is composed of a substantially plate-like abutting section 65*a* and a fixing section 65*b* provided on the rear surface of the abutting section 65*a*; it is fixed by press-fitting the fixing section 65*b* into the bore formed at the end of the piston 53. The tappet 65 is urged by a compression coil spring 55 so that it is always held in contact with the cam 39.

The rest of the constitution of the second embodiment is the same as the constitution of the first embodiment.

The high-pressure fuel supply pump configured as described above obviates the need of a cam roller and a pin, so that it permits lower cost from the reduced number of components and yet it provides the same advantage as that obtained by the first embodiment.

Thus, the high-pressure fuel supply pump according to the present invention has: a casing in which an intake passage for taking fuel in, a discharge passage for discharging fuel, and a cylindrical cavity are formed; a sleeve which has a cylinder section and a flanged fixing section provided on one end of the cylinder section, one end thereof closer to the fixing section being abutted against the bottom of the cavity; and a piston which is disposed in the cylinder section so that it may reciprocate and which constitutes a fuel pressurizing chamber in cooperation with the cylinder section; the high-pressure fuel supply pump taking in fuel by the reciprocation of the piston through the intake passage into the fuel pressurizing chamber to pressurize it, then discharging the pressurized fuel through the discharge passage to forcibly feed it into a fuel injector of a cylinder injection engine; wherein a cylindrical slit is provided between the cylinder section and the fixing section of the sleeve, and the fixing section is secured by being fastened toward the bottom of the cavity by a cylindrical fastening member screwed to the cavity.

Therefore, the sleeve is pushed by a uniform force in the circumferential direction and it accordingly develops uniform deformation in the circumferential direction. Further, since the slit is formed between the cylinder section and the fixing section, it is difficult for the deformation of the fixing section to be transmitted to the cylinder section, resulting in less deformation of the cylinder section; thus, the seizure of the piston can be securely prevented. In addition, the sleeve can be secured to the casing with a greater fastening force, thus permitting improved sealing performance. The result is a high-pressure fuel supply pump with higher performance with minimized chance of fuel leakage.

In a preferred form of the present invention, the high-pressure fuel supply pump further includes the bracket to be secured to an engine; wherein the inside diameter portion of the bracket is positioned by being spigot-fitted to the fastening member. This ensures precise centering of the bracket and also permits easier assembly.

In another preferred form of the present invention, the high-pressure fuel supply pump further includes the driver which is provided between the piston and the engine cam and which transmits the power of the cam to the piston; wherein the bracket guides the driver so that it may reciprocate. Since the bracket is not involved in the fastening of the sleeve, it is not affected by the deformation caused by fastening the sleeve. This allows the driver to be accurately guided so as to ensure smoother reciprocating motion of the piston. The result is a high-pressure fuel supply pump with higher performance.

What is claimed is:

1. A high-pressure fuel supply pump comprising:

a casing in which an intake passage for taking fuel in, a discharge passage for discharging fuel, and a cylindrical cavity are formed;

a sleeve which has a cylinder section and a flanged fixing section provided on one end of said cylinder section, one end thereof closer to said fixing section being abutted against the bottom of said cavity; and a piston which is disposed in said cylinder section so that it may reciprocate and which constitutes, together with said cylinder section, a fuel pressurizing chamber;

said high-pressure fuel supply pump taking in fuel through said intake passage by the reciprocation of said piston into said fuel pressurizing chamber to pressurize it, then discharging the pressurized fuel through said discharge passage to forcibly feed it into a fuel injector of a cylinder injection engine;

wherein a cylindrical slit is provided between said cylinder section and said fixing section of said sleeve, and said fixing section is secured by being fastened toward the bottom of said cavity by a cylindrical fastening member screwed to said cavity.

2. A high-pressure fuel supply pump according to claim 1, further comprising a bracket to be secured to an engine; wherein the inside diameter portion of said bracket is positioned by being spigot-fitted to said fastening member.

3. A high-pressure fuel supply pump according to claim 2, further comprising a driver which is provided between said piston and an engine cam and which transmits the power of said cam to said piston; wherein said bracket guides said driver so that it may reciprocate.

* * * * *